US007560647B2

(12) United States Patent
Sato

(10) Patent No.: US 7,560,647 B2
(45) Date of Patent: Jul. 14, 2009

(54) NON-HALOGENOUS INSULATED WIRE AND A WIRING HARNESS

(75) Inventor: Masashi Sato, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 76 days.

(21) Appl. No.: 11/887,614

(22) PCT Filed: Apr. 28, 2006

(86) PCT No.: PCT/JP2006/308996

§ 371 (c)(1),
(2), (4) Date: Oct. 23, 2007

(87) PCT Pub. No.: WO2006/118253

PCT Pub. Date: Nov. 9, 2006

(65) Prior Publication Data

US 2009/0025978 A1 Jan. 29, 2009

(30) Foreign Application Priority Data

Apr. 28, 2005 (JP) ..... 2005-131340

(51) Int. Cl.
*H01B 7/00* (2006.01)

(52) U.S. Cl. ..... 174/110 R; 174/120 R

(58) Field of Classification Search ..... 174/110 R, 174/110 SR, 110 N, 110 FC, 110 PM, 120 R, 174/120 C, 120 AR, 120 SR
See application file for complete search history.

(56) References Cited

U.S. PATENT DOCUMENTS 5,418,272 A * 5/1995 Kawabata et al. ..... 524/436
6,248,446 B1 * 6/2001 Kikuchi et al. ..... 428/383

FOREIGN PATENT DOCUMENTS

| | | |
|---|---|---|
| JP | A-63-264649 | 11/1988 |
| JP | A-03-254016 | 11/1991 |
| JP | A-11-219626 | 8/1999 |
| JP | A-2000-207952 | 7/2000 |
| JP | A-2001-155554 | 6/2001 |
| JP | A-2001-250432 | 9/2001 |
| JP | A-2002-042573 | 2/2002 |
| JP | B2-3280105 | 2/2002 |
| JP | A-2002-138173 | 5/2002 |
| JP | A-2003-157725 | 5/2003 |

* cited by examiner

*Primary Examiner*—William H Mayo, III
(74) *Attorney, Agent, or Firm*—Oliff & Berridge, PLC

(57) ABSTRACT

A non-halogenous insulated wire [possessing sufficient flame retardancy and excellent heat resistance, wear resistance and flexibility, ]and a wiring harness including the wire. The wire includes a conductor, an inside coat of one or more layers and an outermost coat, wherein the outermost coat is in the range of 10 to 100 μm in thickness and is made from a resin composition including an olefin resin with a melting point of 180 ° C. or more and/or an olefin resin having a —Si(XI) (X 2) (X 3) group, by 20 wt% or more, and at least one of the layers of the inside coat is made from a resin composition including (A) an olefin resin with a melting point of 180 ° C. or more by 50-5 to part weight, (B) an olefin resin by 50 to 95 part weight, and (C) a metallic hydrate by 30 to 250 part weight.

4 Claims, No Drawings

NON-HALOGENOUS INSULATED WIRE AND A WIRING HARNESS

TECHNICAL FIELD

The present invention relates to a non-halogenous insulated wire and a wiring harness, and more specifically relates to a non-halogenous insulated wire having a multilayered structure and a wiring harness including the same.

BACKGROUND ART

Conventionally, insulated wires in which conductors are covered with covering materials made from a resin composition are frequently used in carrying out wiring of parts for a car and electric/electronic equipment. In this type of insulated wires, especially in the insulated wire to be used in a section where heat resistance is required, used as the covering material is a vinyl chloride resin composition of which heat resistance is improved by adjusting types, amounts or polymerization degrees of a thermal stabilizer and a plasticizer to be added thereto, or by forming cross-links therein.

However, there is a problem that this type of vinyl chloride resin composition includes halogen elements, so that it emits harmful halogenous gas into the atmosphere in case of car fire or at the time of combustion for disposing of electric/electronic equipment by incineration, causing environmental pollution.

Therefore, from the view point of reducing loads on the global environment, the vinyl chloride resin composition has been recently replaced with a so-called non-halogenous flame-retardant resin composition, which is prepared by adding a metallic hydrate such as magnesium hydroxide as a non-halogenous flame retardant to an olefin resin such as polyethylene.

However, the olefin resin is essentially combustible, and the non-halogenous flame retardant is inferior to a halogenous flame retardant in effect of flame retardancy. For these reasons, the non-halogenous flame-retardant resin composition requires a large amount of metallic hydrate to be added thereto in order to secure sufficient flame retardancy, thus bringing a disadvantage that mechanical properties such as wear resistance, tensile elongation and tensile strength remarkably degrade.

In order to overcome such a disadvantage, Japanese Patent Gazette No. 3280105, for example, discloses a flame-retardant resin composition which is prepared by adding a metallic hydrate and a cross-linking auxiliary agent to a resin ingredient containing polyethylene or an alpha-olefin copolymer and an ethylene copolymer or a rubber, and by making the resin ingredient further contain a specific functional group.

DISCLOSURE OF THE INVENTION

Problems to be Solved by the Invention

However, the conventional insulated wire in which the conductor is covered with one layer of the flame-retardant resin composition does not suffice in wire properties such as heat resistance, wear resistance and flexibility, so that further improvements need to be made to the insulated wire.

An object of the invention is to overcome the problems described above and to provide a non-halogenous insulated wire which possesses sufficient flame retardancy and excellent heat resistance, wear resistance and flexibility.

Another object of the present invention is to provide a wiring harness including the non-halogenous insulated wire.

Means to Solve the Problem

To achieve the objects and in accordance with the purpose of the present invention, a non-halogenous insulated wire according to a preferred embodiment of the present invention includes a conductor, an inside coat formed of one or more layers and arranged to cover the conductor and an outermost coat arranged to cover the inside coat, wherein the outermost coat is in the range of 10 to 100 μm in thickness and is made from a resin composition including an olefin resin with a melting point of 180° C. or more and/or an olefin resin having a $—Si(X_1)(X_2)(X_3)$ group (where $X_1$, $X_2$ and $X_3$ are an alkyl group or an alkoxy group while at least one of $X_1$, $X_2$ and $X_3$ is the alkoxy group), by 20 wt % or more, and at least one of the layers of the inside coat is made from a resin composition including (A) an olefin resin with a melting point of 180° C. or more by 50 to 5 part weight, (B) an olefin resin by 50 to 95 part weight, and (C) a metallic hydrate by 30 to 250 part weight.

In this case, it is preferable that (A) the olefin resin with the melting point of 180° C. or more included in the inside coat has flexural modulus no higher than that of the olefin resin with the melting point of 180° C. or more included in the outermost coat.

In addition, it is preferable that the outermost coat and/or the inside coat is cross-linked.

Meanwhile, a wiring harness according to the present invention includes the non-halogenous insulated wire.

EFFECTS OF THE INVENTION

The non-halogenous insulated wire according to the present invention has a multilayered structure which is built up of the outermost coat which is in the specified range in thickness and is made from the specified resin composition, and the inside coat formed of one or more layers in which at least one of the layers is made from the specified resin composition.

By the inclusion of the inside coat which includes the specified part weight of metallic hydrate, the non-halogenous insulated wire possesses sufficient flame retardancy.

In addition, by the inclusion of the specified outermost coat and the specified inside coat, even if the non-halogenous insulated wire is used in a section exposed to relatively high temperatures such as surroundings of an auto engine compartment, a covering material of the non-halogenous insulated wire is hardly melted or hardly deformed with heat, so that the non-halogenous insulated wire is excellent in heat resistance.

In addition, by the inclusion of the outermost coat made from the resin composition which is not filled with a large amount of metallic hydrate, the non-halogenous insulated wire is excellent especially in mechanical properties such as wear resistance compared with a conventional insulated wire in which a conductor is covered with one layer of a flame-retardant resin composition containing a large amount of metallic hydrate.

In addition, by the inclusion of the specified outermost coat and the specified inside coat, the non-halogenous insulated wire is excellent in flexibility.

In this case, when (A) the olefin resin with the melting point of 180° C. or more included in the inside coat has flexural modulus no higher than that of the olefin resin with the melting point of 180° C. or more included in the outermost coat, wear resistance of the outermost coat and flexibility of the inside coat are further improved.

In addition, when the outermost coat and/or the inside coat is cross-linked, heat resistance thereof is further improved.

In addition, by the inclusion of the non-halogenous insulated wire, the wiring harness according to the present invention possesses sufficient flame retardancy and excellent heat resistance, wear resistance and flexibility.

Therefore, the non-halogenous insulated wire and the wiring harness can be preferably used especially in a section which is subjected to high temperatures or vibrations, showing high reliability over a long period of time.

BEST MODE FOR CARRYING OUT THE INVENTION

A detailed description of one preferred embodiment of the present invention will now be provided. Incidentally, in the description, a non-halogenous insulated wire according to the preferred embodiment of the present invention is sometimes referred to as "present wire", and a wiring harness according to the preferred embodiment of the present invention is sometimes referred to as "present wiring harness".

1. Non-Halogenous Insulated Wire

The present wire has a multilayered structure such that a conductor is covered with an inside coat and the inside coat is covered with an outermost coat.

1.1 Conductor

For the conductor, a single metallic wire, a strand of a number of individual metallic wires, and a strand of a number of individual metallic wires on which compression is further applied may be used. In addition, the diameter and the material of the conductor are not limited in particular and may be chosen appropriately as usage.

1.2 Outermost coat

In the present wire, the outermost coat is in the range of 10 to 100 μm in thickness, preferably in the range of 15 to 60 μm, and more preferably in the range of 20 to 50 μm.

If the outermost coat becomes less than 10 μm in thickness, a tendency to hardly obtain sufficient wear resistance is shown. On the other hand, if the outermost coat becomes more than 100 μm in thickness, a tendency to hardly obtain sufficient flame retardancy is shown. Accordingly, the thickness of the outermost coat is preferably determined considering these points.

The outermost coat is made from a resin composition for outermost coat which includes an olefin resin with a melting point of 180° C. or more and/or an olefin resin having a —$Si(X_1)(X_2)(X_3)$ group (where $X_1$, $X_2$ and $X_3$ are an alkyl group or an alkoxy group while at least one of $X_1$, $X_2$ and $X_3$ is the alkoxy group).

In other words, the resin composition for outermost coat may include either one of the olefin resin with the melting point of 180° C. or more and the olefin resin having the —$Si(X_1)(X_2)(X_3)$ group, or may include the both. Besides, each of the olefin resin with the melting point of 180° C. or more and the olefin resin having the —$Si(X_1)(X_2)(X_3)$ group may be made of one sort of resin alone, or may be made of more than one sort of resin in combination.

To be specific, polymethylpentene is named for the olefin resin with the melting point of 180° C. or more included in the resin composition for outermost coat. Concerning polymethylpentene, a plurality of sorts of polymethylpentene having different physical properties such as flexural modulus may be mixed.

Meanwhile, in the olefin resin having the —$Si(X_1)(X_2)(X_3)$ group included in the resin composition for outermost coat, the —$Si(X_1)(X_2)(X_3)$ group may be introduced in any form. A methyl group, an ethyl group, a propyl group, a butyl group, a methoxy group, an ethoxy group, a beta-methoxyethoxy group and a butoxy group are named for $X_1$, $X_2$ and $X_3$.

For the olefin resin having the —$Si(X_1)(X_2)(X_3)$ group, an olefin resin having a —$Si(X_1)(X_2)(X_3)$ group which is prepared by grafting a compound containing a —$Si(X_1)(X_2)(X_3)$ group onto a main chain and/or a side chain of an olefin resin using a peroxide, and an olefin resin having a —$Si(X_1)(X_2)(X_3)$ group which is prepared by copolymerizing olefin and/or an olefin resin and a compound containing a —$Si(X_1)(X_2)(X_3)$ group are named.

For the compound containing the —$Si(X_1)(X_2)(X_3)$ group, vinyltrimethoxysilane, vinyltriethoxysilane, and gamma-methacryloxypropyltrimethoxysilane are named. They may be used by one sort alone, or more than one sort in combination.

For the above-described olefin, ethylene, propylene, ethylene-vinyl acetate, and ethylene-acrylate are named. They may be used by one sort alone, or more than one sort in combination.

For the above-described olefin resin, high-density polyethylene (HDPE), medium-density polyethylene (MDPE), low-density polyethylene (LDPE), linear low-density polyethylene (LLDPE), very low-density polyethylene (VLDPE), polypropylene (homopolymer, block polymer, random polymer), polybutylene, an ethylene-vinyl acetate copolymer, an ethylene-acrylate copolymer, an ethylene-methylacrylate copolymer, an ethylene-methylmethacrylate copolymer, an ethylene-butylacrylate copolymer, an ethylene-propylene copolymer, an ethylene-butene copolymer, an ethylene-methylpentene copolymer, an ethylene-hexene copolymer, an ethylene-octene copolymer, an ethylene-dodecene copolymer, and an olefin crystal-ethylenebutylene-olefin crystal block copolymer are named. They may be used by one sort alone, or more than one sort in combination.

In addition, the resin composition for outermost coat includes the olefin resin with the melting point of 180° C. or more and/or the olefin resin having the —$Si(X_1)(X_2)(X_3)$ group, by 20 wt % or more. Here, it is preferable that the content is 25 wt % or more, and it is more preferable that the content is 30 wt % or more.

This is because if the content of the olefin resin with the melting point of 180° C. or more and/or the olefin resin having the —$Si(X_1)(X_2)(X_3)$ group becomes less than 20 wt %, heat resistance is reduced: for example, the wires fuse together with heat in a hot environment of 180° C. or more, or a thermal-deformation volume of a covering material of the wire increases.

For other ingredients of the resin composition for outermost coat, the above-described olefin resins, a styrene-butadiene block copolymer, a styrene-ethylene-propylene block copolymer, polymers prepared by adding hydrogen to the above block polymers so as to break double bonds thereof, and a styrene-ethylenebutylene-olefin crystal block copolymer are named. They may be used by one sort alone, or more than one sort in combination.

In addition, one or more of a cross-linking promoter (e.g., a silanol condensation catalyst such as dibutyltindilaurate, dibutyltindiacetate and dibutyltindioctoate), a thermal stabilizer (e.g., an antioxidant and an antiaging agent), a metal deactivator (e.g., a copper inhibitor), a lubricant (e.g., fatty acid base, fatty acid amide base, metal soap base, hydrocarbon system (wax type), ester system and silicon system), a light stabilizer, a nucleating agent, an antistatic agent, a coloring agent, a flame-retardant auxiliary agent (e.g., silicon system, nitrogen system, zinc borate and phosphorus system), a coupling agent (e.g., silane system and titanate system), a softener (e.g., a processed oil), and a zinc compound (e.g., zinc oxide and zinc sulfide) may be added appropriately to the resin composition for outermost coat.

In addition, the resin ingredients included in the resin composition for outermost coat may be denatured by acid. For the acid, an unsaturated carboxylic acid, and a derivative thereof are named. A maleic acid and a fumaric acid are named for the unsaturated carboxylic acid, and a maleic anhydride, a maleic acid monoester and a maleic acid diester are named for the derivative of the unsaturated carboxylic acid. They may be used by one sort alone, or more than one sort in combination. Besides, the acids of this type can be introduced by a grafting method or a direct (copolymerization) method.

1.3 Inside coat

In the present wire, the inside coat may be formed of one layer only, or may be formed of two or more layers. When the inside coat is formed of two or more layers, the materials and the thicknesses of the two or more layers may be entirely the same, or may be different from each other.

Incidentally, at least one of the layers of the inside coat needs to be made from a specific resin composition for inside coat. The position of the layers of the inside coat made from the specific resin composition for inside coat is not limited.

The resin composition for inside coat includes at least (A) an olefin resin with a melting point of 180° C. or more, (B) an olefin resin, and (C) a metallic hydrate.

For the (A) ingredient, the same olefin resins named for the olefin resin with the melting point of 180° C. or more included in the resin composition for outermost coat can be used.

It is preferable to select among from the olefin resins such that flexural modulus of (A) the olefin resin with the melting point of 180° C. or more included in the resin composition for inside coat is no higher than that of the olefin resin with the melting point of 180° C. or more included in the resin composition for outermost coat. This is because such a configuration allows the outermost coat to be further improved in wear resistance and the inside coat to be further improved in flexibility.

For the (B) ingredient, the same olefin resins named for the olefin resins included in the resin composition for outermost coat can be used.

For (C) the metallic hydrate which is used as a flame retardant, compounds having a hydroxyl group or crystalline water, such as magnesium hydroxide, aluminum hydroxide, zirconium hydroxide, hydrated magnesium silicate, hydrated aluminum silicate, magnesium carbonate and hydrotalcite are named. They may be used by one sort alone, or more than one sort in combination.

The particle size of the metallic hydrate differs depending on the sort. When using the above-described magnesium hydroxide or aluminum hydroxide, it is desirable for them to have an average particle size ($d_{50}$) in the range of 0.1 to 20 μm, preferably in the range of 0.2 to 10 μm, and more preferably in the range of 0.3 to 5 μm. This is because if the average particle size is smaller than 0.1 μm, secondary cohesion between particles occurs to demonstrate a tendency to degrade mechanical properties, and if the average particle size is larger than 20 μm, there are tendencies to degrade the mechanical properties and to give rise to surface roughness.

In addition, the surface of the particle may be subjected to surface finishing using a finishing agent such as a coupling agent (e.g., silane system including aminosilane, vinylsilane, epoxysilane and acrylsilane, and titanate system) and a fatty acid (e.g., a stearic acid and an oleic acid). Instead of subjecting the surface to the surface finishing, the finishing agent may be added to the resin composition by an integral blend method (i.e., the finishing agent may be added to the resin composition as a compounding agent simultaneously at the time of mixing the resins), which is not limited in particular. Besides, the coupling agent may be used by one sort alone, or more than one sort in combination.

In the resin composition for inside coat, it is preferable for blending ratios of the above-described ingredients to be in the ranges as follows: the (A) ingredient is in the range of 50 to 5 part weight, preferably in the range of 40 to 10 part weight, the (B) ingredient is in the range of 50 to 95 part weight, preferably in the range of 60 to 90 part weight, and the (C) ingredient is in the range of 30 to 250 part weight with respect to 100 part weight of the (A) and (B) ingredients, preferably in the range of 50 to 200 part weight, more preferably in the range of 60 to 180 part weight. This is because the present wire is excellent in various physical properties such as flame retardancy, heat resistance, wear resistance and flexibility if the blending ratios are in these ranges.

In addition, the same various additives as the ones added to the resin composition for outermost coat may be added appropriately to the resin composition for inside coat.

Incidentally, when the inside coat is formed of two or more layers, the layer(s) other than the layer(s) made from the resin composition for inside coat can be made from such a non-halogenous flame-retardant resin composition that has physical properties to the extent of not being detrimental to physical properties necessary for the present wire.

The description of a basic configuration of the present wire is provided above. Incidentally, the conductor diameter and the thickness of the entire covering material of the present wire are not limited in particular. It is usually arranged that the outside diameter of the wire is 5 mm or less, preferably 4 mm or less, and the thickness of the covering material including the inside coat and the outermost coat is 0.8 mm or less, preferably 0.4 mm or less so as to be used preferably as a thin-walled wire with a small diameter.

In addition, from the viewpoint of further improving heat resistance, the outermost coat and the inside coat may be cross-linked by the use of, for example, radiation, a peroxide and a silane cross-linking agent.

In addition, in the present wire, the inside coat may be directly covered with the outermost coat, or an intermediate material, for example, a shielded conductor such as a braid or a metallic foil may be interposed between the inside coat and the outermost coat so as to be covered with the outermost coat.

2. Production Process of the Present Wire

A production process of the present wire is not limited in particular, and a publicly known production process may be used. For example, firstly, the resin composition for outermost coat and the resin composition for inside coat are prepared by blending the respective ingredients, and the other ingredients and additives as appropriate, and dry-blending them with the use of a regular tumbler, or melting and kneading them so as to be dispersed uniformly with the use of a regular kneader such as a Banbury mixer, a pressure kneader, a kneading extruder, a twin-screw extruder and a roll.

Next, for example, the conductor is covered with the resin composition for inside coat in a given thickness with the use of an extrusion molding machine, and the thus-obtained inside coat is covered with the resin composition for outermost coat in the specified thickness, whereby the present wire can be produced. Additionally, arbitrary application of radiation to the produced present wire allows formation of cross-links in the covering material.

3. Wiring Harness

The present wiring harness is prepared by covering a single wire bundle including only the present wires, or a mixed wire bundle including the present wires and other insulated wires which are tied into a bundle, with a wiring-harness protective material.

The number of the wires included in the single wire bundle and the number of the wires included in the mixed wire bundle may be determined arbitrarily, which are not limited in particular.

When using the mixed wire bundle, the structure of the other insulated wires is not limited in particular, and the other insulated wires may be covered with a covering material of one layer or more than one layer. In addition, the sort of the covering material for the other insulated wires is not limited in particular.

The above-described wiring-harness protective material fills the role of covering the wire bundle and protecting the wire bundle from an external environment. For example, a wiring-harness protective material having a tape-shaped base material at least one side of which an adhesive is applied on, and a wiring-harness protective material having a tube-shaped or sheet-shaped base material are named, which can be selected and used appropriately as usage.

For the base material from which the wiring-harness protective material is made, a non-halogenous flame-retardant resin composition, a vinyl chloride resin composition, and a halogenous resin composition other than the vinyl chloride resin composition are named.

EXAMPLE

A description of the present invention will now be provided specifically with reference to Examples, however, the present invention is not limited hereto.

Test Material, Manufacturer, and Other Fn actors

Test materials used in the present Examples are given along with manufacturers, trade names, values of physical properties, and other factors.

Outermost Coat

Polymethylpentene #1 (TPX#1) [manuf.: Mitsui Chemicals, Inc., trade name: "TPX MX002", flexural modulus measured in accordance with ASTM D790: 640 MPa]

Polymethylpentene #2 (TPX#2) [manuf.: Mitsui Chemicals, Inc., trade name: "TPX DX820", flexural modulus measured in accordance with ASTM D790: 1570 MPa]

Polypropylene (PP) having a $—Si(X_1)(X_2)(X_3)$ group [manuf.: Mitsubishi Chemical Corporation, trade name: "LINKLON XPM800HM"]

High-density polyethylene (HDPE) having a $—Si(X_1)(X_2)(X_3)$ group [manuf.: Mitsubishi Chemical Corporation, trade name: "LINKLON XHE650N"]

Polypropylene (PP) [manuf.: Japan Polypropylene Corporation, trade name: "NOVATEC EC9"]

Polyethylene #1 (PE#1) [manuf.: Mitsui Chemicals, Inc., trade name: "HI-ZEX 5305E"]

Cross-linking promoter #1 [manuf.: Mitsubishi Chemical Corporation, trade name: "PZ010S"]

Cross-linking promoter #2 [manuf.: Mitsubishi Chemical Corporation, trade name: "LZ015H"]

Antiaging agent #1 [Manuf.: Ciba Specialty Chemicals Inc., trade name: "Irganox 1010"]

Inside Coat (A) Ingredient

Polymethylpentene #1 (TPX#1) [manuf.: Mitsui Chemicals, Inc., trade name: "TPX MX002", flexural modulus measured in accordance with ASTM D790: 640 MPa]

Polymethylpentene #2 (TPX#2) [manuf.: Mitsui Chemicals, Inc., trade name: "TPX DX820", flexural modulus measured in accordance with ASTM D790: 1570 MPa]

(B) Ingredient

Polypropylene (PP) [manuf.: Japan Polypropylene Corporation, trade name: "NOVATEC EC9"]

Polyethylene #1 (PE#1) [manuf.: Mitsui Chemicals, Inc., trade name: "HI-ZEX 5305E"]

Polyethylene #2 (PE #2) [manuf.: Japan polyethylene Corporation, trade name: "KARNEL KF283"]

Styrene-ethylene-butylene-styrene block copolymer (SEBS) [manuf.: Asahi Kasei Chemicals Corporation., trade name: "Tuftec H1041"]

Modified styrene-ethylene-butylene-styrene block copolymer (modified SEBS) [manuf.: Asahi Kasei Chemicals Corporation., trade name: "Tuftec M1913"]

Olefin crystal-ethylenebutylene-olefin crystal block copolymer (CEBC) [manuf.: JSR Corporation, trade name: "DYNARON 6200P"]

Ethylene-vinyl acetate copolymer (EVA) [manuf.: Du Pont-Mitsui Polychemicals Co., Ltd., tradename: "EVAFLEX EV360"]

(C) Ingredient

Magnesium hydroxide [manuf.: Martinswerk GmbH, trade name: "MAGNIFIN H10", average particle size: about 1.0 μm]

Other Ingredients

Antiaging agent #1 [Manuf.: Ciba Specialty Chemicals Inc., trade name: "Irganox 1010"]

Antiaging agent #2 [Manuf.: SHIPRO KASEI KAISHA, LTD., trade name: "Seenox 412S"]

Antiaging agent #3 [Manuf.: Kawaguchi Chemical Industry CO., LTD., trade name: "Antage MB"]

Copper inhibitor [Manuf.: ADEKA CORPORATION, trade name: "CDA-1"]

Zinc oxide [manuf.: Hakusui Tech Co., Ltd., zinc flower]

Zinc sulfide [manuf.: Sachtleben chemie GmbH, trade name: "Sachtolith HD"]

Preparation of resin composition for outermost coat, resin composition for inside coat, and insulated wire Firstly, the respective ingredients shown in the below-described tables were kneaded with the use of a double-shaft extruder, and compounds (pellets) of the resin compositions for outermost coat and the resin compositions for inside coat to be used for insulated wires according to the present Examples and Comparative Examples were prepared.

Next, the obtained pellets of the resin compositions for inside coat and the resin compositions for outermost coat were dried. Then, conductors with a cross sectional area of 0.50 $fmm^2$ (19/0.19) were covered with the resin compositions for inside coat of one layer with the use of an extrusion molding machine so as to form inside coats, and further, the thus-obtained inside coats were covered with the resin compositions for outermost coat so as to form outermost coats. The thicknesses of the entire covering materials including the inside coats and the outermost coats were arranged to be 0.28 mm. The thicknesses of the outermost coats were arranged as shown in the below-described tables. The outside diameters of the wires were arranged to be 1.53 mm.

Next, the insulated wires including the olefin resin having the $—Si(X_1)(X_2)(X_3)$ group were soaked in hot water at 85° C. for 24 hours, and then were dried. Thus, the non-halogenous insulated wires according to the present Examples and the non-halogenous insulated wires according to the Comparative Examples were prepared.

Test Procedure

The non-halogenous insulated wires according to the present Examples and the non-halogenous insulated wires according to the Comparative Examples prepared as above were subjected to a flame-retardancy test, a high-temperature wrapping test, a thermal deformation test, a wear-resistance test and a flexibility test. Hereinafter, descriptions of test procedures and assessment procedures are provided.

Flame-Retardancy Test

The flame-retardancy test was performed based on JASO D611. To be specific, the non-halogenous insulated wires according to the present Examples and the non-halogenous insulated wires according to the Comparative Examples were cut into test specimens 300 mm long, each of which was placed and held horizontal in an iron test box, and a center portion of the test specimen was subjected to the tip of a reducing flame from beneath within 30 seconds until it burned by using a Bunsen burner having a caliber of 10 mm, and then, after the flame was calmly removed, an after flame time of the test specimen was measured. The test specimen whose after flame time was within 15 seconds was regarded as passed, and the test specimen whose after flame time was over 15 seconds was regarded as failed.

High-Temperature Wrapping Test

The non-halogenous insulated wires according to the present Examples and the non-halogenous insulated wires according to the Comparative Examples were wrapped six-fold around objects having outside diameters as large as the outside diameters of the respective insulated wires, which were heated in a constant-temperature oven at 180° C. for 30 minutes and were cooled to room temperatures. The non-halogenous insulated wire in which no fracture or melting occurred in the covering material was regarded as passed, and the non-halogenous insulated wire in which fracture or melting occurred in the covering material was regarded as failed.

Thermal Deformation Test

The thermal deformation test was performed-based on JIS C 3005. To be specific, the covering materials of the non-halogenous insulated wires according to the present Examples and the non-halogenous insulated wires according to the Comparative Examples were measured for thickness before heating, and then the insulated wires were put in a testing machine which was preheated to 180° C. and were heated therein for 30 minutes, and were placed between parallel plates of a measurement apparatus, were subjected to a load of 150 kgf and were kept at the above-described temperature for 30 minutes, and then while the insulated wires were left in this state, the covering materials thereof after heating were measured for thickness. Then, decrease rates (%) of the thicknesses of the covering materials were calculated according to the following expression:

Decrease rate (%)=(Thickness of covering material before heating [mm]−Thickness of covering material after heating [mm])/Thickness of covering material before heating [mm]×100.

The insulated wire having a decrease rate of 40% or less was regarded as passed, and the insulated wire having a decrease rate of more than 40% was regarded as failed.

Wear-Resistance Test

The non-halogenous insulated wires according to the present Examples and the non-halogenous insulated wires according to the Comparative Examples were inserted into corrugated tubes, and were subjected to vibrations under conditions of a frequency of 30 Hz, an acceleration of 44.0 $m/s^2$, a temperature of 100° C., and a time of 240 hours. The insulated wire of which the covering material wore out but its conductor was not exposed was regarded as passed, and the insulated wire of which the covering material wore out so that its conductor was exposed was regarded as failed.

Flexibility Test

The non-halogenous insulated wires according to the present Examples and the non-halogenous insulated wires according to the Comparative Examples were assessed by touch when bending the respective insulated wires by hands. The insulated wire which had a good feel was regarded as passed, and the insulated wire which had a bad feel was regarded as failed.

Blending ratios of the ingredients and assessment results of the outermost coats and the inside coats of the non-halogenous insulated wires according to the present Examples and the non-halogenous insulated wires according to the Comparative Examples are shown in the following Tables 1 and 2.

TABLE 1

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| Outermost coat thickness (μm, average value) | | | 30 | 10 | 70 | 40 | 100 | 50 | 30 | 40 | 30 | 40 |
| Outermost coat | | TPX #1 | | 100 | | | | | | 50 | 30 | |
| | | TPX #2 | 20 | | | | 100 | | | 20 | | 50 |
| | | PP having —$Si(X_1)(X_2)(X_3)$ group | | | 20 | 100 | | | 50 | | | |
| | | HDPE having —$Si(X_1)(X_2)(X_3)$ group | | | | | | 80 | | | | |
| | | PP | 80 | | 80 | | | | 50 | 30 | 70 | |
| | | PE #1 | | | | | | 20 | | | | 50 |
| | | Cross-linking promoter #1 | | | 3 | 5 | | | 3 | | | |
| | | Cross-linking promoter #2 | | | | | | 3 | | | | |
| | | Antiaging agent #1 | 0.5 | | | | | 0.5 | | | | |
| Inside coat | A | TPX #1 | 50 | 5 | 50 | | | 20 | 30 | 30 | | 30 |
| | | TPX #2 | | | | 5 | 5 | | | | 20 | |
| | B | PP | 20 | 80 | 20 | 85 | 45 | | 50 | 40 | 30 | |
| | | PE #1 | | | | | | 60 | | | | 30 |
| | | PE #2 | | | | | | | | 10 | 20 | 20 |
| | | SEBS | | | | 10 | 30 | | | | | |
| | | Modified SEBS | 10 | 15 | 10 | | 20 | 10 | 20 | 20 | 30 | 20 |
| | | CEBC | | | 20 | | | 10 | | | | |

TABLE 1-continued

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| | | EVA | 20 | | | | | | | | | |
| | C | Magnesium hydroxide | 120 | 70 | 100 | 30 | 250 | 100 | 90 | 110 | 140 | 140 |
| | Others | Antiaging agent #1 | 3 | 2 | 3 | 3 | 2 | 3 | 3 | 3 | 3 | 3 |
| | | Antiaging agent #2 | | | | | | 1 | | 1 | | 0.5 |
| | | Antiaging agent #3 | | 3 | 3 | | | 2 | | 4 | 2 | |
| | | Copper inhibitor | 1 | 0.5 | 1 | 1 | 1 | 0.5 | 1 | 1 | 1 | 1 |
| | | Zinc oxide | | | 3 | | 3 | | | 4 | 3 | |
| | | Zinc sulfide | | | | | | 3 | | | | 5 |
| Flame-retardancy | | | passed | passed | passed | passed | passed | passed | passed | passed | passed | passed |
| High-temperature wrapping | | | passed | passed | passed | passed | passed | passed | passed | passed | passed | passed |
| Thermal deformation | | | passed | passed | passed | passed | passed | passed | passed | passed | passed | passed |
| Wear-resistance | | | passed | passed | passed | passed | passed | passed | passed | passed | passed | passed |
| Flexibility | | | passed | passed | passed | passed | passed | passed | passed | passed | passed | passed |

TABLE 2

| | | | Comparative example | | | | | | |
|---|---|---|---|---|---|---|---|---|---|
| | | | 1 | 2 | 3 | 4 | 5 | 6 | 7 |
| Outermost coat thickness (μm, average value) | | | 50 | 40 | 60 | 40 | 5 | 120 | 30 |
| Outermost coat | | TPX #1 | | 60 | | | | | |
| | | TPX #2 | 10 | | 100 | | | | |
| | | PP having —$Si(X_1)(X_2)(X_3)$ group | | | | 100 | 80 | | 10 |
| | | HDPE having —$Si(X_1)(X_2)(X_3)$ group | | | | | | 90 | |
| | | PP | 90 | 40 | | | 20 | | 90 |
| | | PE #1 | | | | | | 10 | |
| | | Cross-linking promoter #1 | | | | 5 | 4 | | 5 |
| | | Cross-linking promoter #2 | | | | | | 4 | |
| | | Antiaging agent #1 | | | | | | 0.5 | |
| Inside coat | A | TPX #1 | 30 | | | 60 | | | 20 |
| | | TPX #2 | | | 20 | | 20 | 30 | |
| | B | PP | 50 | 40 | 60 | 20 | 30 | | 50 |
| | | PE #1 | | | | | | 30 | |
| | | PE #2 | | | | | | | |
| | | SEBS | | | 20 | | 30 | 40 | |
| | | Modified SEBS | 20 | | | | | | 20 |
| | | CEBC | | 20 | | 20 | | | |
| | | EVA | | 40 | | | 20 | | 10 |
| | C | Magnesium hydroxide | 100 | 80 | 20 | 280 | 100 | 50 | 70 |
| | Others | Antiaging agent #1 | 3 | 3 | 2 | 3 | 2 | 3 | 3 |
| | | Antiaging agent #2 | | 1 | | | | | |
| | | Antiaging agent #3 | | | 1 | | | | |
| | | Copper inhibitor | 0.5 | 0.5 | 1 | 0.5 | 1 | 0.5 | 1 |
| | | Zinc oxide | 3 | | | | | | |
| | | Zinc sulfide | | | | | | | |
| Flame-retardancy | | | passed | passed | failed | passed | passed | failed | passed |
| High-temperature wrapping | | | failed | passed | passed | passed | passed | passed | failed |
| Thermal deformation | | | failed | failed | passed | passed | passed | passed | failed |
| Wear-resistance | | | passed | passed | passed | passed | failed | passed | passed |
| Flexibility | | | passed | passed | passed | failed | passed | passed | passed |

According to Table 2, it was shown that all of the non-halogenous insulated wires according to the Comparative Examples gave results of "failed" in any of the assessment items of flame-retardancy, high-temperature wrapping, thermal deformation, wear-resistance and flexibility.

To be specific, the Comparative Example 1, in which the resin composition for outermost coat included the olefin resin with the melting point of 180° C. or more with the weight percentage smaller than the specified weight percentage, melted and had a larger thermal deformation volume, being inferior in heat resistance.

The Comparative Example 2, in which the resin composition for inside coat did not include (A) the olefin resin with the melting point of 180° C. or more, had a larger thermal deformation volume, being inferior in heat resistance.

The Comparative Example 3, in which the resin composition for inside coat included (C) the metallic hydrate with the part weight below the specified range of part weights, was inferior in flame retardancy.

The Comparative Example 4, in which the resin composition for inside coat included (C) the metallic hydrate with the part weight above the specified range of part weights, was inferior in flexibility.

The Comparative Example 5, in which the outermost coat had the thickness below the specified range of thicknesses, was inferior in wear resistance. Besides, it is obvious that an insulated wire having no outermost coat is inferior in wear resistance to the insulated wire according to the Comparative Example 5.

The Comparative Example 6, in which the outermost coat had the thickness above the specified range of thicknesses, was inferior in flame retardancy.

The Comparative Example 7, in which the resin composition for outermost coat included the olefin resin having the —$Si(X_1)(X_2)(X_3)$ group with the weight percentage smaller than the specified weight percentage, melted and had a larger thermal deformation volume, being inferior in heat resistance.

On the other hand, according to Table 1, it was shown that the non-halogenous insulated wires according to the present Examples were superior all in flame retardancy, heat resistance, wear resistance and flexibility.

The invention claimed is:

1. A non-halogenous insulated wire comprising:

a conductor;

an inside coat formed of one or more layers and arranged to cover the conductor; and an outermost coat arranged to cover the inside coat, wherein the outermost coat is in the range of 10 to 100 μm in thickness, and is made from a resin composition including at least one of:

an olefin resin with a melting point of 180 ° C. or more; and an olefin resin having a —Si(XI)(X2)(X3) group (where XI, X2 and X3 are any one of an alkyl group and an alkoxy group while at least one of Xl, X2 and X3 is the alkoxy group), by 20 wt% or more, at least one of the layers of the inside coat is made from a resin composition including:

(A) an olefin resin with a melting point of 180 ° C. or more by 50 to 95 part weight;

(B) an olefin resin by 50 to 95 part weight; and (C) a metallic hydrate by 30 to 250 part weight, and (A) the olefin resin with the melting point of 180 ° C. or more included in the inside coat has flexural modulus no higher than that of the olefin resin with the melting point of 180 ° C. or more included in the outermost coat.

2. The non-halogenous insulated wire according to claim 1, wherein at least one of the outermost coat and the inside coat is cross-linked.

3. A wiring harness comprising the non-halogenous insulated wire according to claim 2.

4. A wiring harness comprising the non-halogenous insulated wire according to claim 1.

* * * * *

UNITED STATES PATENT AND TRADEMARK OFFICE

CERTIFICATE OF CORRECTION

PATENT NO. : 7,560,647 B2
APPLICATION NO. : 11/887614
DATED : July 14, 2009
INVENTOR(S) : Masashi Sato It is certified that error appears in the above-identified patent and that said Letters Patent is hereby corrected as shown below:

Title Page, Item (57)

Abstract

In lines 1-3 of the Abstract, please remove "[possessing sufficient flame retardancy and excellent heat resistance, wear resistance and flexibility,]".

In line 12 of the Abstract, please change "50-5 to" to --5 to 50--.

In the Claims:

Claim 1, column 14, line 9, please change "50 to 95" to --50 to 5--.

Signed and Sealed this

Twenty-second Day of September, 2009

David J. Kappos

David J. Kappos
*Director of the United States Patent and Trademark Office*